United States Patent [19]

Silva

[11] Patent Number: 4,627,794

[45] Date of Patent: Dec. 9, 1986

[54] FLUID PRESSURE INTENSIFIER

[76] Inventor: Ethan A. Silva, 410 McAuley, Oakland, Calif. 94609

[21] Appl. No.: 738,061

[22] Filed: May 24, 1985

Related U.S. Application Data

[63] Continuation-in-part of Ser. No. 454,062, Dec. 28, 1982, Pat. No. 4,523,895.

[51] Int. Cl.[4] ..... F04B 17/00

[52] U.S. Cl. ..... 417/225; 417/400

[58] Field of Search ..... 417/396, 225, 400, 403, 417/404, 401, 393; 91/276, 313, 348, 466, 304, 314; 137/625.63, 625.66, 596.15

[56] References Cited

U.S. PATENT DOCUMENTS 1,332,845 3/1920 Keller ..... 91/276

4,523,895 5/1985 Silva ..... 417/225

*Primary Examiner*—Leonard E. Smith

[57] ABSTRACT

A fluid pressure intensifier characterized by unitary construction of a bistable control mechanism, and a reciprocating assembly within a main cylinder providing unrestricted flow and optional modes of operation.

13 Claims, 2 Drawing Figures

FLUID PRESSURE INTENSIFIER

CROSS REFERENCES TO RELATED APPLICATIONS

This application is a continuation-in-part of co-pending application number 06/454,062, filed 12/28/82, and entitled "FLUID INTENSIFIER", now U.S. Pat. No 4,523,895.

BACKGROUND OF THE INVENTION

1. Field of the Invention

This invention relates generally to pumps and more particularly to piston pumps for increasing fluid pressure.

2. Description of the Prior Art

Fluid intensifiers utilize the energy of a fluid at low pressure to pump a fluid at a higher pressure. Fluid pumps utilize the energy of a driving fluid to pump a driven fluid.

A piston type intensifier is described in U.S. Pat. No. 4,212,597 of Mallofre. This intensifier includes a main cylinder provided with a high pressure outlet, a spool cylinder provided with a low pressure inlet, a spool disposed within the spool cylinder, and a multihead piston disposed within the main cylinder. When a pressurized fluid source is applied to the low pressure inlet, the multihead piston is caused to reciprocate within the main cylinder assembly to develop a high fluid pressure at the pressure outlet.

A problem with piston type fluid intensifiers as described in the Mallofre patent is that they require a very stable continuous fluid force in order to operate. Piston type fluid intensifiers tend to become stuck in mid-cycle if the fluid source is interrupted because they depend on the momentum of the continuous operation to control the stroke direction of the pump pistons. If the pump pistons are stopped in mid-cycle by a loss of fluid source pressure, they could equally well move in either direction when fluid source pressure is reapplied. Rather than move in one direction or the other, the pump pistons often jam.

Some prior art piston type fluid intensifiers address this problem by providing biasing mechanisms to prevent the intensifier mechanism from being immobilized in mid-cycle. For example, Wrigley, in U.S. Pat. No. 2,826,149 provides a spring loaded overcenter mechanism for just such a purpose. Problems with biasing mechanisms is that they too can become stuck and that they add to the cost of the intensifier.

In U.S. Pat. No 2,818,022 of Kangas, the moving piston contacts a spring loaded switch at each end of the stroke which redirects the influx and efflux of fluid so that the piston reverses direction to maintain the pumping action and pressure intensification. Since the momentum of the pistons is not required to maintain pumping action at midstroke, the pumping action can be resumed in spite of temporary interruptions of fluid flow. This pump is intended for uses such as using a hydraulic power supply to pump fluid (oil) from deep underground where it is required to pump fluid from two different levels simultaneously. In this arrangement, the discharged fluid is two separate mixtures. Each mixture contains the hydraulic fluid and one of the fluids pumped from the ground.

U.S. Pat. No. 4,523,895 of Silva also eliminates the mid-cycle sticking problem associated with piston pumps by eliminating dependence on momentum of the piston in midstroke. This is accomplished by the piston face pushing a collar at each end of the stroke. The collar, concentric with the bore of the piston cylinder, moves first in one direction to cover a first set of orifices and uncover a second set of orifices so that the redirected flow of fluid reverses the main valve position reversing the motion of the piston; then the collar is moved in the reverse direction at the other end of the stroke to restore the original direction of fluid flow and motion of the piston.

In the construction of the pump described in the Silva patent, the collar positioned in the cylinder of the piston directs fluid flow to either end of a spool, slideably enclosed in a housing which is separate from the main piston cylinder. Grooves, circumferentially located on the spool, connect the fluid inlet to either end of the piston and the flow lines for fluid displaced from the low pressure end of the piston cylinder to the exhaust exit. The necessarily small cross sectional area of these flow channels of this construction imposes a constriction which limits the rate of flow through the pump. Furthermore, the additional flow lines required for the construction of the pump according to the Silva patent also imposes an additional expense.

SUMMARY OF THE INVENTION

A major objective of this invention is to provide a fluid intensifier which can operate more reliably and is less expensive by virtue of compact and versatile design than the intensifiers of the prior art.

Another objective of this invention is to provide a fluid intensifier wherein the rate of flow of fluid is not limited by constrictions in the fluid control valve and fluid lines which characterize the intensifiers of the prior art.

Briefly, the invention includes a fixed assembly and reciprocating assembly disposed within a main cylinder assembly, and a bistable valve assembly. The main cylinder assembly includes a main cylinder with a head assembly on both ends. Each head is multi-chambered and is provided with check valves which direct the incoming and outgoing fluid flow.

Centrally located inside the main cylinder is the fixed assembly including a fixed piston supported by a pair of hollow, central tubes, each of which extends to a head at the end of the main cylinder assembly. Holes in the sides of the tube permit passage of fluid to and from pressurized regions within the main cylinder.

The reciprocating assembly includes a pair of movable pistons located so that one movable piston is on each side of the fixed piston. The movable pistons are attached to one another by a movable cylinder which slides on the fixed piston.

The bistable valve assembly includes a tubular collar sliding on the inside of the main cylinder between the two movable pistons and a spool cylinder which slides on the outside of the main cylinder. A housing encloses the spool cylinder and a portion of the main cylinder and provides the passages through which fluid passes between regions within the main cylinder near the heads and the inlet and exhaust ports. The manner by which the heads are constructed so as to support the main cylinder and housing while simultaneously permitting the flow of fluid between the main cylinder and passage formed by the housing surrounding the main cylinder is a key element resulting in the unrestricted flow of fluid provided by the pressure intensifier of this invention.

When the reciprocating assembly nears the end of its stroke in one direction it pushes the collar to a first stable position thereby directing fluid to one end of the controlling cylinder so as to shift the controlling cylinder to its first stable position. This causes fluid from the source to flow through a head into one end of the main cylinder and thereby reverses the motion so that the reciprocating assembly moves away from this end.

The motion of the reciprocating assembly causes three simultaneous events. Firstly, fluid is exhausted from the second end of the main cylinder at low pressure; secondly, fluid from a pressure intensifying region in the main cylinder assembly bounded by the fixed and a first movable piston is ejected at an increased pressure; and thirdly, a second region in the main cylinder bounded by the fixed and second movable piston is filled with fluid.

When the reciprocating assembly nears the end of its stroke it pushes the collar to a second stable position thereby redirecting fluid to the other end of the controlling cylinder so as to shift the controlling cylinder to its second stable position. This causes fluid to flow to the second end of the main cylinder and reverses the motion of the reciprocating assembly thereby causing the three simultaneous events to occur at the other end of the main cylinder assembly.

A second embodiment of this invention can utilize a pressurized fluid to pump a second (and perhaps dissimilar) fluid at an increased pressure. For this purpose, the only change required in the apparatus described in the foregoing paragraphs is the substitution of heads. Each head now has an additional orifice which admits fluid to be pressurized from a source (which may or may not be different from the pressurized source) through a check valve leading through the central tubes to the pressurizing regions within the main cylinder assembly.

An advantage of this invention is that it can operate from an interruptable pressurized fluid source. The position of the bistable valve mechanism indicates the direction of motion of the reciprocating assembly at the instant that fluid flow from the source is interrupted and ensures that direction of motion is maintained after the fluid flow from the source is restored.

Furthermore, even if the cycle is interrupted at the instant of collar crossover, the controlling cylinder is still operative and will cause the pistons to move the collar past the operating point. This ability is particularly enhanced by the cross sectional are of the controlling orifices which characterize the cylindrical construction of the bistable valve assembly of this invention and are much larger than the controlling orifices of the prior art.

In addition, the cylindrical construction of the bistable valve assembly provides annular or cylindrical passages which greatly increases the cross sectional areas of the passages connecting source with heads so that a reduced resistance to fluid flow is provided which permits a greater rate of flow and greater efficiency than the constructions of the prior art. The increased cross sectional area also reduces fluid velocity and thus this region can act as a settling area for dirt, sludge, and debris. The enlarged size of the valve assembly and subsequent passages furthermore provides a quicker response time due to the proximity of the collar and valve, and the enlarged ports.

The head construction of the present invention also facilitates the use of spring loaded check valves which increases the reliability of the pump. The present construction provides for easy access to the moving parts as required therefore reducing maintenance costs.

Yet another advantage of this invention is that the internal parts of the device can be easily removed, inspected, and replaced. This also provides for the possibility of changing the ratio of the piston head areas to vary the operational characteristics of the intensifier.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
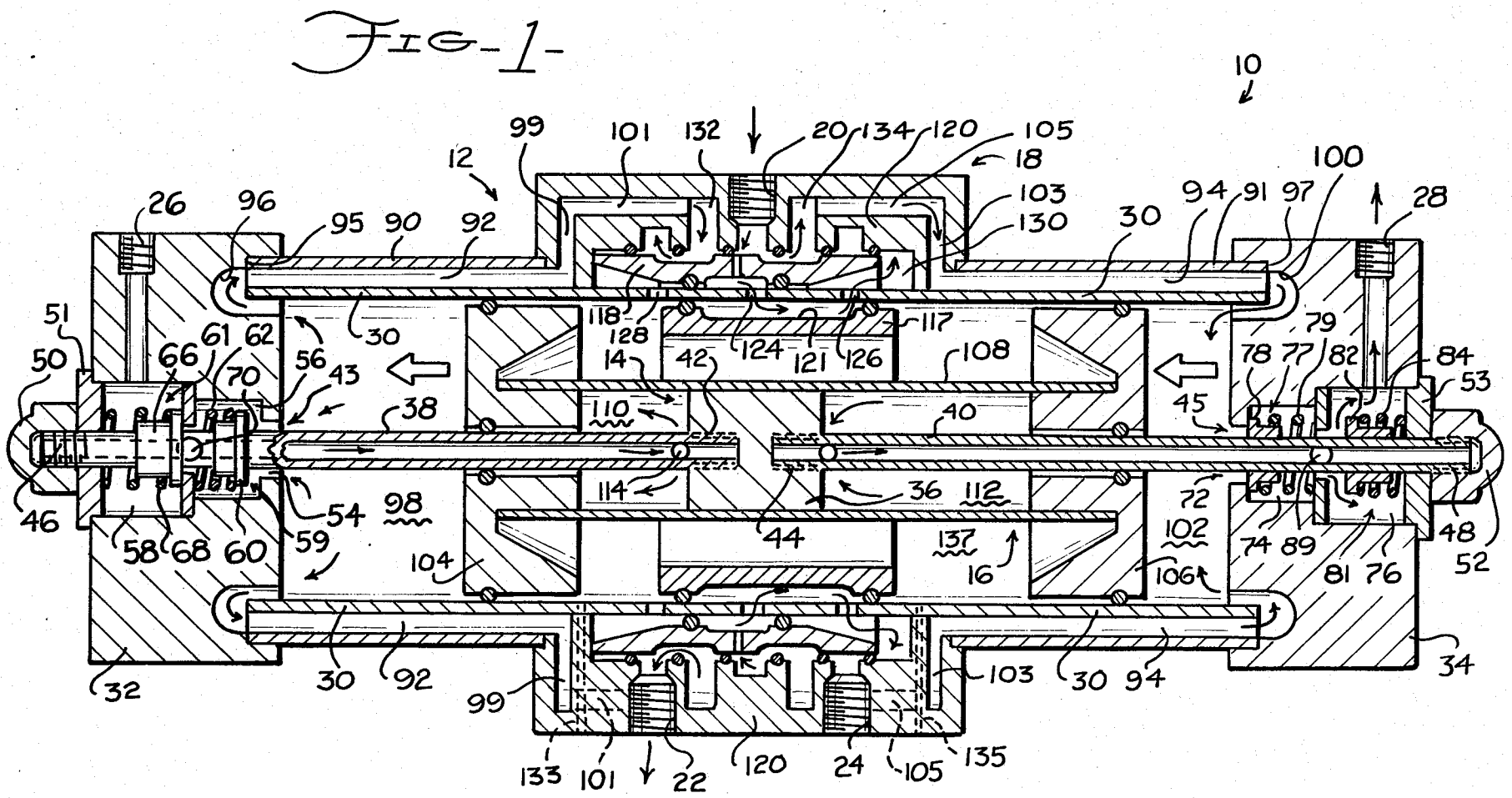
FIG. 1 is a cross sectional view of a fluid intensifier in accordance with the present invention where the position of the bistable valve assembly is positioned near the beginning of a pump cycle.

Referring to FIG. 1, a fluid intensifier 10 in accordance with the present invention includes an elongated main cylinder assembly 12, a fixed assembly 14 disposed within the main cylinder assembly 12, a reciprocating assembly 16 aligned by the fixed assembly 14 within the main cylinder assembly 12, and a bistable valve assembly 18 associated with main cylinder assembly 12. Fluid intensifier 10 has a low pressure inlet 20, a pair of exhaust outlets 22 and 24 and a pair of high pressure outlets 26 and 28. Often, exhaust outlets 22 and 24 will be coupled together and high pressure outlets 26 and 28 will be coupled together.

Main cylinder assembly 12 includes a main cylinder 30 with a head 32 on one end and a head 34 on the other end. Heads 32 and 34 are readily removable from the main cylinder 30 for maintenance.

The fixed assembly 14 includes a fixed piston 36 held fixed in the center of the main cylinder 30 by hollow central tubes, 38 and 40. The tubes 38 and 40 are provided with threaded ends 42 and 44 which engage threaded bores in fixed piston 36. The other ends of tubes 38 and 40 extend through central orifices 43 and 45 in heads 32 and 34, respectively. The extended ends 46 and 48 of central tubes 38 and 40 are also threaded so that nuts 50 and 52 can be screwed onto the threaded ends 46 and 48 to force sealing plates 51 and 53 against heads 32 and 34, respectively, thereby positioning the heads 32 and 34 at the ends of the main cylinder 30 and maintaining the fixed piston 36 in the center of main cylinder 30.

The central orifice 43 has three connecting chambers, namely, an entry chamber 54 communicating with the main cylinder 30, a first chamber 56 communicating with entry chamber 54, and a second chamber 58 communicating with first chamber 56. A first check valve 59, including a loading spring 62 and a stool 60 which slides on central tube 38, permits fluid to flow only from the main cylinder adjacent to the head 32 through the entry chamber 54 to the first chamber 56. A second check valve 61 including a spring 68 and a stool 66 sliding on the central tube 38 permits fluid to flow only from first chamber 56 to second chamber 58. Hole 70 in central tube 38 is positioned inside first chamber 56 and provides for flow of fluid from the first chamber 56 to the interior of central tube 38 by opening check valve stool 60 if pressure in the central tube 38 is low, and from the interior of central tube 38 to the second chamber 58 by opening check valve stool 66 if pressure in the central tube 38 is high. High pressure outlet 26 leads diametrically from the second chamber 58 to the surface of the head 32 where a threaded connection can be made.

The compartmental construction of central orifice 43 provides the spring loaded mounting of the check valve stools 60 and 66 sliding on the central tube 38 which serves as a tie rod holding the entire intensifier together. This construction provides for easy removal of the check valves for inspection or replacement by simply removing one nut 50. Spring loading provides for improved reliability of the check valve performance.

Head 34 is similarly provided with a central orifice 45 having an entry chamber 72, a first chamber 74, and a second chamber 76. A first check valve 77 including a valve stool 78 and a spring 79, and a second check valve 81 including a valve stool 82 and spring 84 are also provided. A hole 89 in central tube 40 positioned in first chamber 74 provides communication between the interior of central tube 40 and first chamber 74, or between second chamber 76 and high pressure outlet 28.

As discussed above, the central tubes 38 and 40 serve as tie rods to position the heads 32 and 34 at the ends of the main cylinder 30. The head 32 is provided with a partially relieved seat 96 having a construction which permits simultaneously clamping the head 32 onto a cylindrical housing 90 and passing fluid from within the main cylinder to a cylindrical passage 92 formed between the main cylinder and the housing 90 which surrounds the main cylinder 30. A similar arrangement is provided by a partially relieved seat 100 for clamping head 34 to a housing 91 forming a cylindrical passage 94 with the main cylinder 30.

The end of housing 90 abuts a shoulder 95, and the end of housing 91 abuts a shoulder 97. The ends of the main cylinder 30 are supported by solid segments (not seen in the drawing) of the partially relieved seats 96 and 100 so that fluid can pass around the ends of the cylinder 30. It is this construction of the partially relieved seat 96 which provides for unrestricted flow of fluid between the main cylinder and the passages 92 and 94 leading to the fluid source and exhaust ports, thereby providing the large pumping capacity that characterizes this invention.

Grooved seat 96 in head 32 provides for passage of fluid between passage 92 and a low pressure region 98 in the main cylinder bounded on one side by head 32. Similarly, partially relieved seat 100 in head 34 connects passage 94 to a low pressure region 102 in the main cylinder 30 bounded on one side by head 34. Passages 92 and 34 lead to input orifice 20 or to exit orifices 22 and 24, depending on the position of the bistable valve assembly. Passage 92 communicates with a radial passage 99 and an axial passage 101, and passage 94 communicates with a radial passage 103 and an axial passage 105.

The reciprocating assembly 16 includes moving pistons 104 and 106 which slide on central tubes 38 and 40 to form boundaries for low pressure regions 98 and 102 respectively. Moving cylinder 108 slides on the fixed piston 36 and connects the moving pistons 104 and 106. The moving cylinder 108 and the fixed piston 36 with moving piston 104 enclose an high pressure region 110, and with moving piston 106 enclose another high pressure region 112. Communication from the interior of central tubes 32 and 34 to high pressure regions 110 and 112 is provided by holes 114 and 116 respectively.

The bistable valve assembly 18 includes a collar 117 sliding on the inside surface of the main cylinder 30, a movable spool cylinder 118 sliding on the outside surface of main cylinder 30, and a stationary valve housing 120 which encloses the spool cylinder 118.

The collar 117 slides on the inside surface of the main cylinder 30 between the moving pistons 104 and 106. A circumferential groove 121 provided on the outer surface of the collar 117 permits flow of fluid from low pressure inlet 20 through valve inlet hole 124 to valve outlet hole 126 in the main cylinder 30 when the collar 117 is in a first stable position and through valve inlet hole 124 to valve inlet hole 28 in the main cylinder 30 when the collar 117 is in a second stable position.

Fluid through the valve outlet hole 126 provides a pilot pressure which passes to end 130 of spool cylinder 118 so as to shift the spool cylinder 118 to a first stable position (as shown), and fluid through valve outlet hole 128 provides a pilot pressure which passes to the other end 132 of spool cylinder 118 and to shifts the spool cylinder 118 to a second stable position (not shown).

As shown in FIG. 1, when the spool cylinder 118 is in the first stable position, exhaust fluid can pass from passage 92 through passages 99 and 101 and into a passage 132 formed by a circumferential groove in the spool cylinder 118 to exhaust outlet 22, and fluid through the low pressure inlet 20 can pass through passage 134 formed by a second circumferential groove in the spool cylinder 118 and on into passage 94 via passages 105 and 103. When the spool cylinder 118 is in the second stable position fluid passes through the low pressure inlet 20, through passages 101 and 99 an into to passage 92, and from passage 94 through passages 103 and 105 and out exhaust outlet 24. Drains 133 and 135 are provided through valve housing 120 to provide an outlet for any fluids which may have drained into the central chamber 137 of the apparatus.

The intensifier is caused to operate by fluid under low pressure entering low pressure inlet 20. If the bistable valve assembly 18 is in the first position as shown in FIG. 1, the fluid will pass through passages 134, 105, 103, and 94 to low pressure region 102, thereby forcing the entire reciprocating assembly 16 to move towards head 32. Fluid in high pressure region 112 will be forced under high pressure to enter central tube 40 through hole 116, open check valve 81 against the back pressure on high pressure outlet 28, flow through second chamber 76, and exit through high pressure outlet 28. The pressure in the high pressure region 112 will equal the product of the low pressure in low pressure region 102 times the ratio of the cross sectional area of the moving cylinder 108 divided by the cross sectional area of the main cylinder 30, minus the friction losses of the system. Simultaneously, fluid is drawn from the low pressure region 98 to open the check valve 59 to pass through central tube 38 and into the high pressure region 110. Fluid also passes from low pressure region 98 through passage 92 and out of exhaust outlet 22. The pressure of region 98 is not sufficient to open check valve 61 against the back pressure at high pressure outlet 26.

As the reciprocating assembly 16 approaches the end of the stroke, moving piston 106 pushes the collar 117 causing it to move to the second stable position. Fluid now passes through hole 124 to hole 128 causing spool cylinder 118 to shift to the right to assume the second stable position. Fluid from low pressure inlet 20 passes through passage 92 to low pressure region 98 causing the reciprocating assembly 16 to reverse its direction of motion. Fluid is now expelled under high pressure from high pressure region 110 to open check valve 61 against the back pressure and to flow out of high pressure outlet 26, and high pressure region 112 is refilled with fluid as fluid is discharged from low pressure region 102 through exhaust outlet 24.

Figure 2:
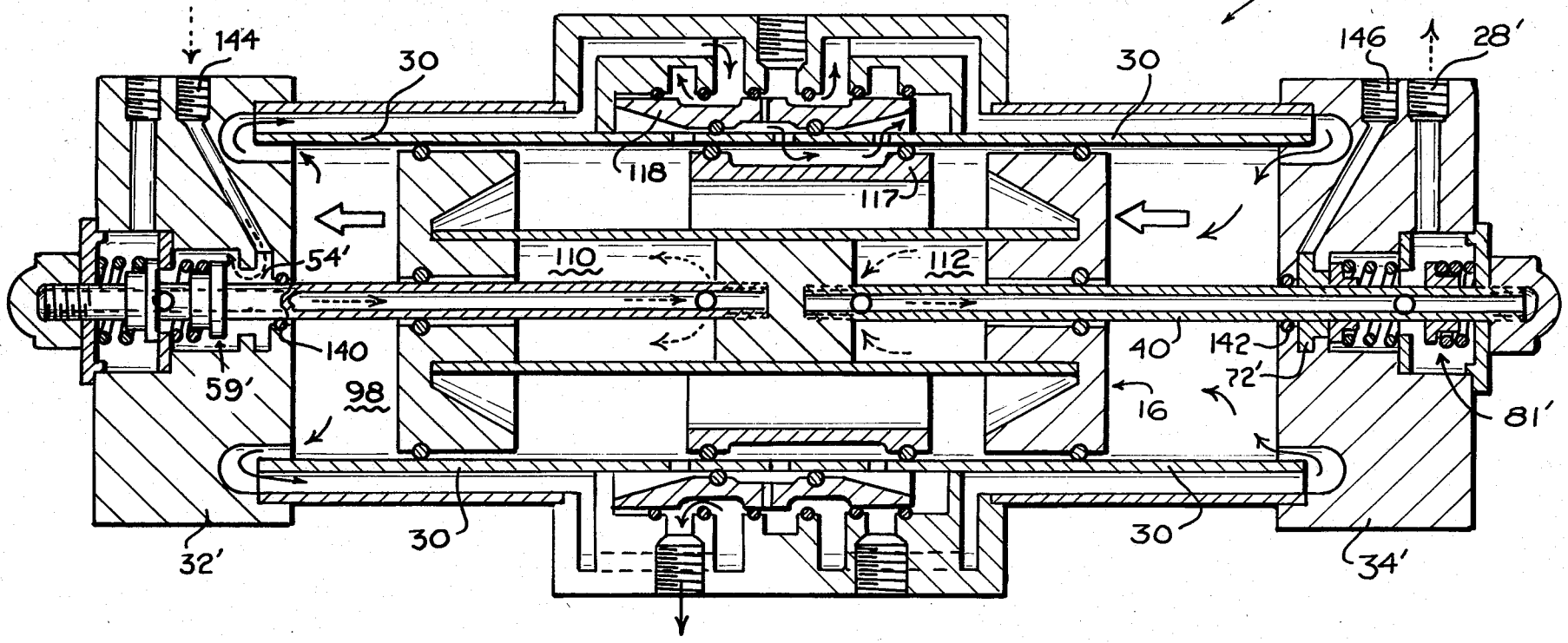
FIG. 2 is a cross sectional view of a fluid intensifier in accordance with the present invention in which fluid from one source is used to pump fluid from a second source, whereby a separation of the fluids is maintained.

The embodiment of this invention discussed with reference to FIG. 1 is used to increase a portion of fluid from a low pressure value to a higher pressure value. A second embodiment 10' (as seen in FIG. 2) provides for using a source of a driving fluid at low pressure to increase the pressure of a driven fluid without necessarily mixing the fluids. The driven fluid may be from the same source as the driving fluid, or it may be derived from an entirely different source. Mechanically, the second embodiment differs from the first embodiment only in the construction of the heads of the main cylinder assembly.

In FIG. 2, a fluid driven pump 10' is shown that is substantially the same as the intensifier shown in FIG. 1, except for modifications to the heads 32' and 34'. Seals 140 and 142 at entry chambers 54' and 72', respectively, prevent driving fluid in the main cylinder 30 from mixing with driven fluid admitted through fluid entries 144 and 146. The fluid entries 144 and 146, respectively, lead to the entry chambers 54' and 72'.

In the operation of pump 10', driving fluid is admitted through low pressure inlet 20 and, in accordance with the position of the spool cylinder 118 shown in FIG. 2, drives the reciprocating assembly 16 towards head 32'. Driven fluid in high pressure region 112 is thereby forced under increased pressure to flow through central tube 40, open check valve 81' and pass out through high pressure outlet 28'. Simultaneously, driven fluid passes through entry 144 opens valve 59' and fills high pressure region 110. Meanwhile driving fluid is also forced out of low pressure region 98 in the main cylinder 30. When the reciprocating assembly 16 approaches the end of its stroke, collar 117 is pushed to the second stable position so as to reverse the direction of motion as previously discussed.

The construction of the present invention is such that the intensifier can be quickly taken apart for repair, inspection or modification. For example and with reference to FIG. 1, removing only the two nuts 50 and 52 allows heads 32 and 4 to be removed which permits the withdrawal of the reciprocating assembly 16 and the fixed assembly 14. This provides the means for easily changing the pressure ratios by substituting different fixed and reciprocating assemblies.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. In fluid pressure intensifier including an elongated body, a reciprocating assembly located within the body adapted to be driven back and forth by a fluid, and a control mechanism for controlling the direction in which said reciprocating assembly is moving, an improved control mechanism comprising a valve housing surrounding said elongated body, a spool cylinder disposed within said valve housing and surrounding said elongated housing, and means responsive to the position of said reciprocating assembly and operative to direct a pilot pressure to said spool cylinder, said spool cylinder directing the flow of an input fluid through passages provided in said body to move said reciprocating assembly in a desired direction.

2. An improved control mechanism as recited in claim 1 wherein said means responsive to the position of said reciprocating assembly includes a collar disposed within said elongated body which is moved at the end of a stroke of said reciprocating assembly, said collar being operative to direct said pilot pressure to move said spool cylinder.

3. A fluid pressure intensifier powered by a pressurized fluid source comprising:

(a) an elongated main cylinder assembly having a first head provided with a first outlet, and a second head provided with a second outlet;

(b) a stationary assembly including a fixed piston centrally located within said main cylinder assembly, a first tube extending between said first head and said fixed piston, said first tube having openings proximate said first head and said fixed piston which permit fluid to flow through said first tube, and a second tube extending between said second head and said fixed piston, said second tube having openings proximate said second head and said fixed piston which permit fluid to flow through said second tube;

(c) a reciprocating assembly including a first movable piston disposed within said main cylinder assembly between said first head and said fixed piston, a second movable piston disposed within said main cylinder assembly between said second head and said fixed piston, and a movable cylinder coupling said first movable piston to said second movable piston and enclosing said fixed piston; whereby said reciprocating assembly completes a pump cycle with a first stroke in the direction of said second head and a second stroke in the direction of said first head, such that fluid is pumped through said first tube and out said first outlet during said first stroke, and pumped through said second tube and out said second outlet during said second stroke;

(d) bistable valve means having an inlet, said bistable valve means being coupled to said main cylinder assembly and having a first stable state and a second stable state; said bistable valve means being caused to move from said first stable state to said second stable state at the end of said first stroke by said reciprocating assembly, and being caused to move from said second stable state to said first stable state at the end of said second stroke by said reciprocating assembly; said bistable valve directing a portion of said pressurized fluid flowing into said inlet against said first movable piston when in said first stable state, and directing a portion of said pressurized fluid against said second movable piston when in said second stable state;

(e) pilot means which directs a pilot pressure to a first pilot hole in said main cylinder during said first stroke and which directs a pilot pressure to a second pilot hole in said main cylinder during said second stroke; and (f) a spool cylinder surrounding and slideable on said main cylinder, and a fixed valve housing surrounding said control cylinder, where the position of said spool cylinder is determined by which of said pilot holes is supplied with said pilot pressure, said spool cylinder directing said pressurized fluid to said first movable piston when in a first position, and directing said pressurized fluid to said second movable piston when in a second postion.

4. A fluid pressure intensifier as recited in claim 3 wherein said pilot means includes a collar disposed within said main cylinder assembly between said first movable pistion and said second movable piston, said collar being pushed by said reciprocating assembly from a first stable position to a second stable position at the end of said first stroke and from said second stable position to said first stable position at the end of said second stroke, said collar directing said pilot pressure to said first pilot hole while in said first stable position and to said second pilot hole while in said second stable position.

5. A fluid pressure intensifier powered by a pressurized fluid source comprising:

(a) an elongated main cylinder assembly including a main cylinder, a first head attached to a first end of said main cylinder and having a first grooved seat, a first central orifice, and a first high pressure outlet communicating with said first central orifice, and a second head attached to a second end of said main cylinder and having a second grooved seat, a second central orifice, and a second high pressure outlet communicating with said second central orifice;

(b) a fixed assembly including a fixed piston centrally located within said main cylinder assembly, a first central tube extending from within said first central orifice to said fixed piston and having a first hole in said tube within said first central orifice and a second hole proximate said fixed piston, a second central tube extending from within said second central orifice and said fixed piston and having a third hole within said second central orifice and fourth hole proximate said fixed piston;

(c) a reciprocating assembly including a first movable piston disposed within said main cylinder assembly between said first head and said fixed piston and sliding on said first central tube, a second movable piston disposed within said main cylinder assembly between said second head and said fixed piston and sliding on said second central tube, and a movable cylinder coupling said first movable piston to said second movable piston and enclosing said fixed piston so that a first high pressure region enclosing said second hole is defined by the fixed piston, the movable cylinder, and the first movable piston, a second high pressure region enclosing said fourth hole is defined by said fixed piston, said movable cylinder, and said second movable piston, a first low pressure region is defined by said first head, said first moving piston, and said main cylinder, and a second low pressure region defined by said second head, said second movable piston, and said main cylinder, said reciprocating assembly completing a cycle with a first stroke in the direction of said first head and a second stroke in the direction of said second head; whereby fluid is pumped from said second high pressure region through said second central tube and out said second high pressure outlet during said first stroke and fluid is pumped from said first high pressure region through said first central tube and out said first high pressure outlet during said second stroke; and (d) a bistable valve means including a housing enclosing said main cylinder and having a first end attached at said first grooved seat so as to form a first passage between the main cylinder and housing which communciates through the first grooved seat to said first low pressure region in the main cylinder, said housing having a second end attached at said second grooved seat so as to form a second passage between the main cylinder and housing which communicates through the second grooved seat to said second low pressure region in the housing; and valving means which can move from a first stable state at the end of said first stroke to a second stable state at the end of said second stroke, said valving means coupling said pressurized fluid source through said first passage and said first grooved seat to said first low pressure region when in said second stable state, and coupling said pressurized fluid source through said second passage and said second grooved seat to said second low pressure region when in said first stable state.

6. A fluid pressure intensifier as in claim 5 wherein said first grooved seat is a surface of said first head having a first shoulder so that a first edge of said housing may abut said first shoulder, and where a first edge of said main cylinder is positioned within said groove, and said second grooved seat is a surface of said second head having a second shoulder so that a second edge of said housing may abut said second shoulder, where a second edge of said main cylinder is positioned within said second groove thereby permitting fluid to flow around said first edge and said second edge of said main cylinder.

7. A fluid pressure intensifier as in claim 5 wherein said valving means includes collar means disposed within said main cylinder assembly between said first movable piston and said second movable piston, said collar means being pushed by said reciprocating assembly from a first stable position to a second stable position at the end of said first stroke and from said second stable position to said first stable position at the end of said second stroke.

8. A fluid intensifier as in claim 5 wherein the surface of said main cylinder assembly is provided with a valve inlet hole leading from a pressurized fluid source, a first valve outlet hole, and a second valve outlet hole, where said valve inlet hole is coupled to said second valve outlet hole when said collar means is in said first stable position and said valve inlet hole is coupled to said first valve outlet hole when said collar means is in said second stable position.

9. A fluid intensifier as recited in claim 8 wherein said valving means further includes a spool cylinder which surrounds and which may slide on the main cylinder, a valve housing surrounding said spool cylinder so as to form a first passage from said first valve outlet hole to a first end of said spool cylinder and a second passage from said second valve outlet hole to a second end of said spool cylinder so as to control the position of said spool cylinder within said valve housing by fluid flow through said first and second passage; said spool cylinder coupling said pressurized fluid source to said first low pressure region when said collar is in said second stable position and coupling said pressurized fluid source to said second low pressure region when said collar is in said first stable position.

10. A fluid pressure intensifier as recited in claim 9 wherein said valve housing is further provided with exhaust outlet means, and wherein said spool cylinder couples said first passage to said exhaust outlet means so as to exhaust said first low pressure region when said collar is in said first stable position and couples said second passage to said exhaust outlet so as to exhaust said second low pressure region when said collar is in said second stable position.

11. A fluid pressure intensifier as recited in claim 5 wherein said first central orifice and said second central orifice each include an entry chamber communicating with a low pressure region, a first chamber, a first check valve disposed within said first chamber which permits fluid to flow only from said entry chamber to said first chamber, a second chamber communicating with a high pressure outlet, and a second check valve disposed within said second chamber which permits fluid to flow only from said first chamber to said second chamber.

12. A fluid pressure intensifier as in claim 4 wherein said first chamber is larger than said entry chamber, and said second chamber is larger than said first chamber, whereby shoulders are provided to seat said check valves.

13. A fluid pressure intensifier as recited in claim 11 wherein both of said first head and said second head are further provided with a fluid entry leading from the surface of said first head to said entry chamber, and a seal between said low pressure region and said entry chamber, whereby a pressurized driving fluid supplied from said pressurized fluid source cycles the pump and flows out said exhaust outlet means and a driven fluid supplied to said fluid entries passes into the first and second high pressure regions and then passes out through the first and second high pressure outlets at increased pressure.

* * * * *